US009180354B2

(12) United States Patent
Wolf

(10) Patent No.: US 9,180,354 B2
(45) Date of Patent: Nov. 10, 2015

(54) DEVICE AND METHOD FOR PRACTICING THE GOLF SWING

(76) Inventor: Robert Wolf, Seeboden (AT)

( * ) Notice: Subject to any disclaimer, the term of this patent is extended or adjusted under 35 U.S.C. 154(b) by 123 days.

(21) Appl. No.: 13/988,414

(22) PCT Filed: Nov. 11, 2011

(86) PCT No.: PCT/EP2011/005696

§ 371 (c)(1),
(2), (4) Date: Jun. 21, 2013

(87) PCT Pub. No.: WO2012/069148

PCT Pub. Date: May 31, 2012

(65) Prior Publication Data

US 2013/0267340 A1 Oct. 10, 2013

(30) Foreign Application Priority Data

Nov. 26, 2010 (DE) ..... 10 2010 052 670

(51) Int. Cl.
*A63B 69/36* (2006.01)
*A63B 71/06* (2006.01)

(52) U.S. Cl.
CPC ..... *A63B 69/36* (2013.01); *A63B 69/3641* (2013.01); *A63B 69/3644* (2013.01); *A63B 71/0619* (2013.01); *A63B 71/0622* (2013.01); *A63B 2069/367* (2013.01); *A63B 2071/0655* (2013.01); *A63B 2071/0694* (2013.01); *A63B 2207/02* (2013.01); *A63B 2220/00* (2013.01); *A63B 2220/10* (2013.01); *A63B 2220/20* (2013.01); *A63B 2220/30* (2013.01); *A63B 2220/40* (2013.01); *A63B 2220/56* (2013.01); *A63B 2220/805* (2013.01); *A63B 2225/09* (2013.01); *A63B 2225/093* (2013.01)

(58) Field of Classification Search
USPC ..... 473/218, 221, 226, 229, 257, 259, 268, 473/409
See application file for complete search history.

(56) References Cited

U.S. PATENT DOCUMENTS

| | | | | | |
|---|---|---|---|---|---|
| 1,634,102 | A * | 6/1927 | Hansen | 473/229 |
| 1,944,942 | A * | 1/1934 | MacDonald | 473/259 |
| 3,730,531 | A * | 5/1973 | Zega | 473/259 |
| 3,795,399 | A * | 3/1974 | Beckish | 473/229 |
| 4,280,701 | A * | 7/1981 | Beckish | 473/221 |
| 4,871,175 | A * | 10/1989 | Levin et al. | 473/218 |
| 5,419,562 | A * | 5/1995 | Cromarty | 473/269 |
| 5,984,798 | A * | 11/1999 | Gilmour | 473/221 |
| 6,039,658 | A * | 3/2000 | Cecchin | 473/269 |
| 7,670,233 | B2 * | 3/2010 | Jones | 473/257 |
| 7,806,780 | B1 | 10/2010 | Plunkett | |
| 2010/0216562 | A1 | 8/2010 | Van Rensburg | |

FOREIGN PATENT DOCUMENTS

| | | | | |
|---|---|---|---|---|
| WO | WO2009007903 | * | 1/2009 | A63B 69/36 |
| WO | 2009038274 | A1 | 3/2009 | |

* cited by examiner

*Primary Examiner* — Nini Legesse
(74) *Attorney, Agent, or Firm* — Abel Law Group, LLP

(57) ABSTRACT

The invention relates to a device and to a corresponding method for practicing the golf swing with a guide (10) along which a golf club can be guided on a specified path. In order to allow the specification of a golf club path without unnecessarily limiting the freedom of movement of the golf player, the guide (10) has at least one subsection (15) which lies in the specified path in a first position and deviates from the specified path in a second position. Furthermore, a device (16, 17) is provided which can bring the subsection (15) from the first position into the second position.

18 Claims, 13 Drawing Sheets

DEVICE AND METHOD FOR PRACTICING THE GOLF SWING

BACKGROUND OF THE INVENTION

1. Field of the Invention

The present invention relates to a device and a corresponding method for practicing the golf swing.

2. Discussion of Background Information

The golf swing is considered to be one of the most difficult movement sequences in sport and is usually learnt and practiced under the instruction of a golf instructor. An alternative or additional possibility for practicing the golf swing are training devices, with the aid of which the golf player can practice the typical movement sequence with and also without golf instructors.

An important requirement for a specific golf swing is that the golf club is always guided in the correct plane. This requires a good posture and the correct combination of body twist, wrist angle, underarm rotation and arm swing.

Known from the prior art are training devices having a circular or arcuate guide, to which the golf club can be coupled and guided along by means of one or more guide elements attached to the shaft of the club.

It is the object of the present invention to provide a device and a corresponding method which enables an improved golf swing training.

SUMMARY OF THE INVENTION

The device according to the invention is characterised in that a guide along which a golf club can be guided on a specified path comprises at least one subsection which lies in the specified path in a first position and deviates from the specified path in a second position. Furthermore, a device is provided which can bring the subsection from the first into the second position and conversely.

In the method according to the invention, a golf club is guided along a guide on a specified path and a subsection of the guide is brought from a first position in which the subsection lies in a specified path into a second position in which the subsection deviates from the specified path.

The specified path preferably has a circular course and in particular has the shape of a circular arc. In principle, however the specified path can also have a shape deviating from a circular course, preferably the shape of an ellipse arc.

The invention is based on the idea of configuring a part of the guide path in such a manner that during specific phases of the golf swing, preferably during the backswing and downswing, this lies in the guide path and serves as a guide for the golf club, and in certain other phases of the golf swing, preferably in the follow-through and/or finish, is removed from the guide track so that the golf club can no longer come in contact with this part of the guide. As a result, it is achieved in a simple manner that the golf player on the one hand can reliably guide the golf club along the specified guide path with the result that a guidance of the golf club in the correct plane is supported and accordingly can be practiced and on the other hand, in specific phases of the golf swing is not unnecessarily restricted in its freedom of movement by the guide path. The golf swing training is more efficient and better as a result.

In a first embodiment of the invention, the device is configured so that the subsection is brought into the second position in at least one phase of the golf swing. This has the advantage that in phases of the golf swing in which an exact guidance of the golf club on a specified path is not absolutely necessary or is not desired for specific training purposes such as, for example, during the follow-through and/or finish, the subsection is removed from the original path or can be brought into a position deviating from this and therefore allows the golf player additional freedoms of movement during the golf swing.

In a further embodiment, the golf club, in particular in at least one phase of the golf swing, cannot come in contact with the subsection located in the second position. This ensures a particularly high degree of additional freedom of movement.

The device can in particular be configured so that the subsection of the guide can be pivoted from the first into the second position and conversely. A pivoting of the subsection constitutes a particularly easy-to-achieve, controllable and at the same time reliable possibility of bringing the subsection from the first into the second position.

Preferably the subsection is attached to the remainder of the guide by means of a hinge. The pivoting movement can preferably be achieved by a motor drive which is coupled to the hinge directly or indirectly, in particular by means of a transmission. It is also possible to achieve the pivoting movement by means of a hydraulic drive which is coupled to the subsection. In a particularly simple realization of the pivoting movement, merely a locking mechanism, e.g. a lock, is provided by which means the subsection is held in the first position on the guide. When releasing the locking mechanism, the subsection is released and can follow the force of gravity, whereby this is folded out from the specified path.

In a further embodiment of the invention, the device can bring the subsection from the first into the second position by moving, in particular pivoting, this subsection in the direction of a rear region of the guide. In this connection, the rear region of the guide is to be understood as the region which is located behind the golf player and which lies opposite the front region of the guide along which the golf club is guided on the specified path.

Preferably the device is configured so that the subsection can be displaced from the first into the second position. By this means the subsection can be brought in a simple and precise manner from the first into the second position and conversely.

In this case, the device can have a carriage mechanism by which means the subsection, in particular can be displaced along the profile of the guide. The carriage mechanism can preferably be achieved by one or more skids located on the subsection which engage in corresponding guide grooves on the guide. Alternatively or additionally a plurality of pairs of rollers can be disposed in the region of the guide, through which a guide rail attached to the subsection can be moved. Conversely it is possible to provide the pairs of rollers on the subsection and the guide rail in the region of the guide. The carriage mechanism ensures the displacement of the subsection in a secure and robust manner.

It is also preferably that the subsection is located at an upper free end of the guide. This ensures a guidance of the golf club during the backswing and downswing in a first position of the subsection without restricting the freedom of movement of the golf player during the follow-through and in particular during the finish when the subsection is located in its second position outside the specified path in these phases.

It is additionally preferable that the guide has a position inclined towards the vertical in space. In particular, the inclination of the guide towards the vertical is adjustable whereby the device can be adapted to the specific conditions such as, for example, the height, constitution and swing technique of the golf player and requirements such as, for example, the desired training purpose.

Alternatively or additionally, means are provided by which means the height of the guide over the base can be adjusted. To this end, for example, screws provided with locknuts on which the guide sits can be used. It is also possible to provide the guide with legs whose length can be adjusted by means of hydraulics. The adjustment of the desired height of the guide can be made thereby in a convenient and rapid manner. Through these measures the device can also be adapted to the specific conditions and needs during training.

In a further embodiment of the invention, one or more sensors are provided in the region of the guide for detecting the position and/or orientation and/or speed and/or acceleration of the golf club guided along the path. The sensors can comprise optical sensors such as, for example, light barriers for detecting the presence of the golf club at a specific location on the guide path or distance sensors for detecting the distance between the golf club and the guide path. It is also possible to use induction sensors, which emit an electromagnetic alternating field which generates eddy currents in the golf club made of electrically conducting material as it passes by, which eddy currents change the amplitude of the electromagnetic alternating field and can be detected in this way.

The quantities detected by the sensors can be displayed on a display device such as, for example, a computer with a screen. The display device is preferably configured in such a manner that this derives information from the detected quantities which is compared with specified information. From the detected locations of the golf club, the display device can preferably determine its path by interpolation, which path is in turn output to the display device with a specified ideal path and compared with this. The same applies to the detected distance and the orientation derived from this, for the speed and the acceleration of the golf club along the path. Through this measure the golf player can easily identify any deviations of his golf swing from specified values and specifically alter the course of the swing even in the absence of a golf instructor.

In a further advantageous embodiment of the device according to the invention, a detection device is provided for detecting a position and/or a posture and/or a weight shift of a golf player. By this means, information about the position or posture of the golf player or the shift of weight onto both legs of the golf player during the individual phases of the golf swing required for a correct guidance of the golf club in the correct plane can be obtained. As a result, a practicing of the golf swing with the aid of the device according to the invention becomes more efficient. For detecting the position or posture of the golf player, the detection device can, for example, comprise a plurality of optical and/or acoustic sensors by which means the location and the position of individual body parts of the golf player, in particular the feet, the legs or the upper body can be determined in a non-contact manner. From the detected position or posture of the golf player during the golf swing it is also possible to determine the change in the weight shift into the legs. The determined position, posture or weight distribution can be displayed by a display device and/or compared with desired values in order to possibly provide the golf player with appropriate feedback, for example, correction information.

In a preferred further development of the invention, the detection device comprises a pressure distribution sensor which can detect a pressure distribution in the region of at least one foot of the golf player, in particular during the golf swing. By this means a measure for the weight shift both into the legs—e.g. from the left to the right leg—and also in the region of the individual foot surface—e.g. from the toes to the heel—of the golf player during the golf swing can be determined directly in a simple manner. The pressure distribution sensor can be disposed on the floor on which the device is standing in such a manner so that the golf player can stand on the sensor with or without shoes during the training. Alternatively or additionally, however, a pressure distribution sensor can also be integrated in the soles of the shoes of the golf player, for example, in the form of a pressure-sensitive shoe insert. In order to ensure the largest possible freedom of movement during training, it can be advantageous here to relay the output signals of the respective pressure distribution sensor by means of non-contact signal transmission to a control unit for further processing and possibly display.

In a further advantageous embodiment of the device according to the invention, an output device is provided for outputting information relating to a position and/or a posture and/or a weight shift of a golf player. In this way, the golf player can be given the information required for a correct execution of the golf swing in relation to his spatial position, body posture or the shift of his body weight onto both legs and in particular onto individual regions of the feet. In the simplest case, this is accomplished by a visual display, e.g. in the form of light signals or a screen display or an acoustic display, e.g. in the form of signal tones or speech instructions. In this case, the output information can be derived from the position, posture or weight shift of the golf player detected by the detection device and in particular have the character of a correction instruction when the detected position, posture or weight shift deviates from a desired value. Alternatively or additionally, however, the output information can also have the character of information which is already given before reaching a specific swing phase or however only during a specific swing phase in order to remind the golf player of the correct position, body and/or club posture or weight shift.

Preferably the output device is configured for outputting a haptic signal, in particular in the form of one or several impacts or a vibrations, to a foot of the golf player. By this means appropriate information on the correct posture, position or weight shift can be transmitted to the golf player in a simple, reliable and intuitively easy-to-detect manner. For example, in the floor region of the site provided for the golf player, a tappet driven by an electromechanical actuator is provided which knocks against a foot, in particular against the outer shoe sole of the foot of the golf player or transmits vibrations and thereby gives him a sign to shift the body weight onto this foot. Preferably the actuator with tappet is disposed relative to the provided location so that this knocks against or transmits vibration to the rear region, in particular in the heel region of the foot or the shoe sole.

The advantages and advantageous embodiments of the detection device or the output device have been explained previously in connection with the present invention. Alternatively the said advantages of the detection device or output device also come into effect however when the subsection of the guide is not brought or cannot be brought from the first into the second position and conversely.

A device for practicing the golf swing comprising a guide along which a golf club can be guided on a specified path can therefore also be considered to be an invention, where the device is characterised by a detection device for detecting a position and/or posture and/or a weight shift of a golf player and/or by an output device for outputting information relating to a position and/or posture and/or a weight shift of a golf player. The preferred embodiments described in connection with the present invention and their advantages can also be combined or achieved with this alternative invention.

BRIEF DESCRIPTION OF THE DRAWINGS

Further advantages, features and possible applications of the present invention are obtained from the following description in connection with the figures. In the figures.

DETAILED DESCRIPTION OF THE INVENTION

Figure 1:
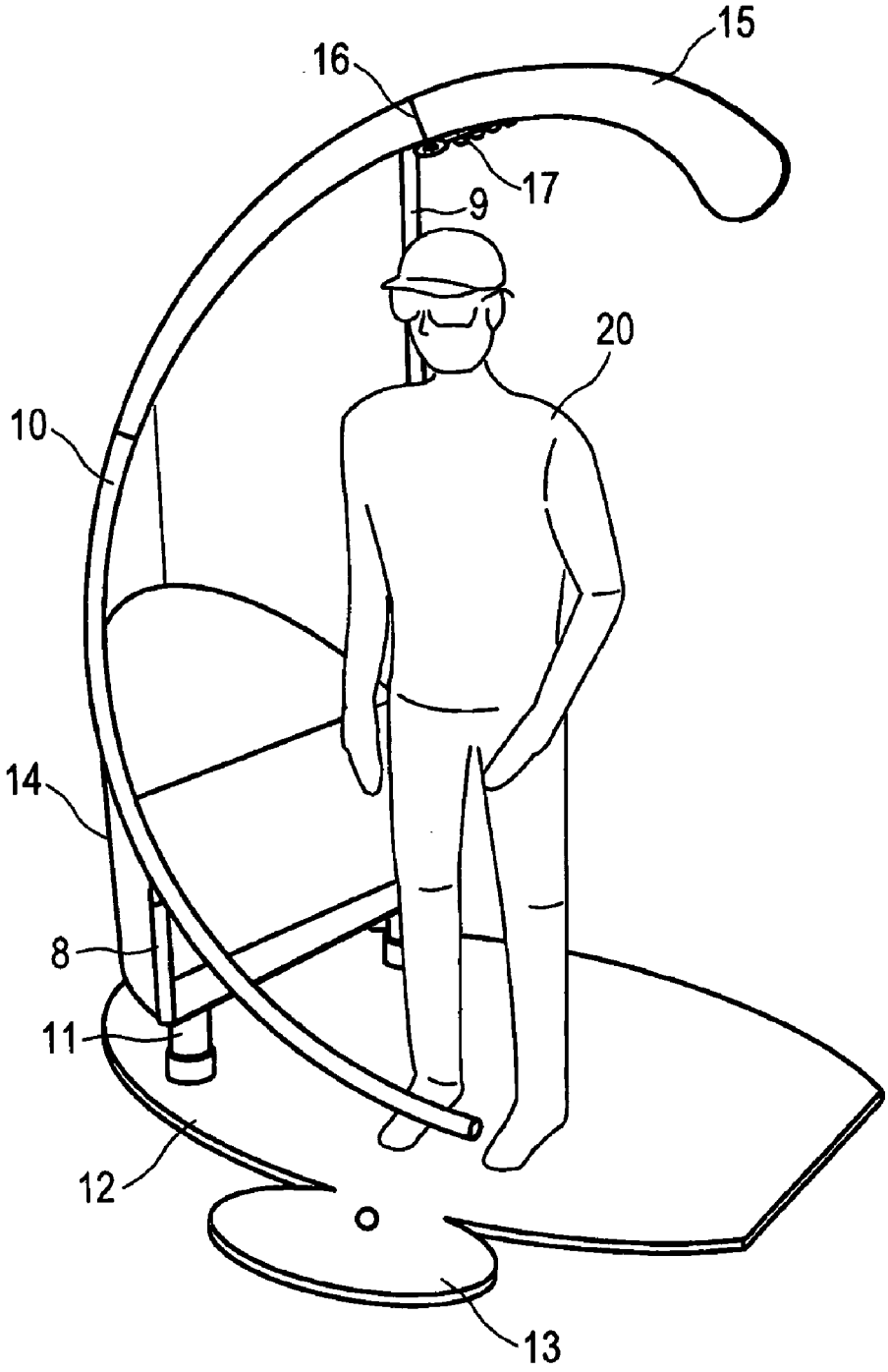
FIG. 1 shows a perspective front view of the first example of the device according to the invention.

FIG. 1 shows a perspective front view of a first example of the device according to the invention. An arcuate guide 10 is formed in the lower region thereof by a curved rod which goes over into a flattened section in the upper region.

The guide 10 is supported by two vertically running rods 8 and 9 which stand with legs 11 on a base plate 12. A curved wall 14 which additionally supports the guide 10 is provided between the rods 8 and 9. In the front region of the base plate 12 on which a golf player 20 stands when practicing, a tee-off plate 13 is provided on which the golf ball is placed when practicing. If required, a so-called tee on which the ball can be placed can be pushed onto the tee-off plate 13.

In the example shown here, the guide 10 with its specified path along which the golf player 20 guides the golf club when practicing lies substantially in a plane which is inclined towards the vertical with the result that the golf player 20 when standing upright projects from the plane with his upper body.

In the upper region of the guide 10, this has a subsection 15 which forms the upper free end of the guide 10. The subsection 15 is pivotally mounted on the guide 10 by means of a hinge 16 and can be pivoted out from the original path of the guide 10 with the aid of a hydraulic system 17.

Figure 2:
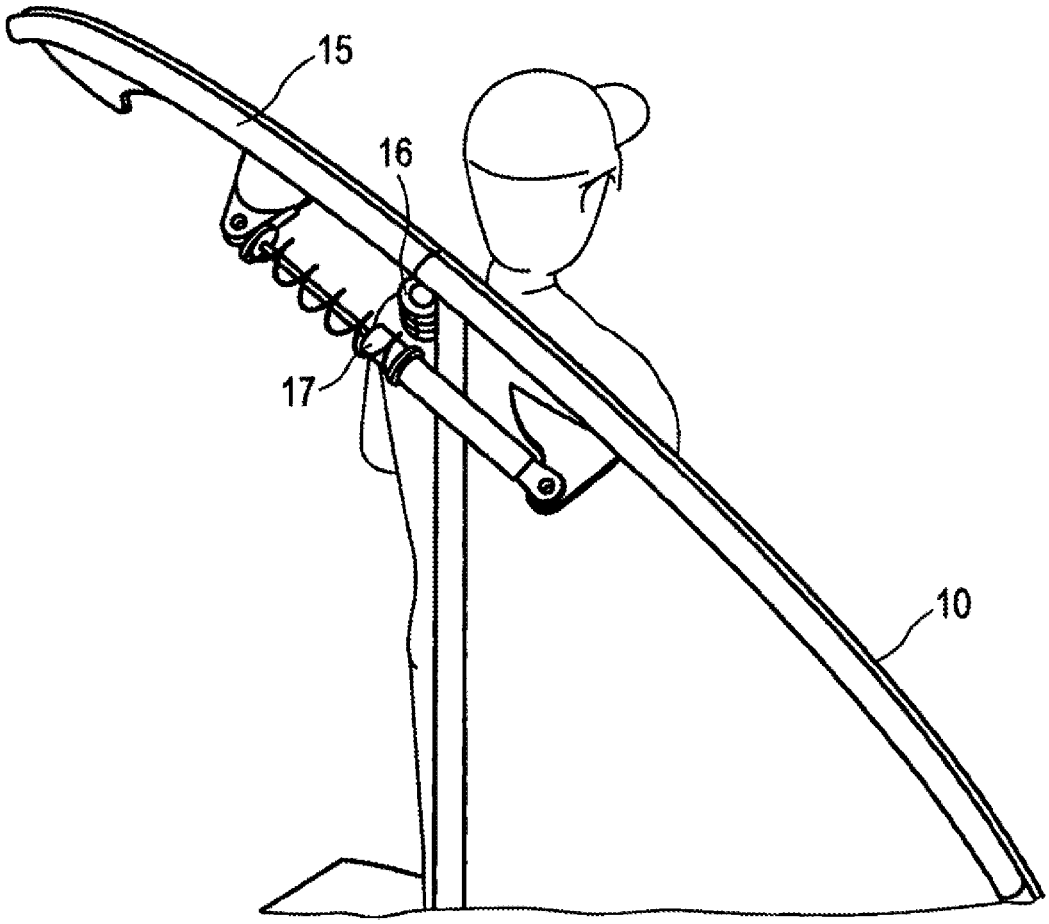
FIG. 2 shows a perspective rear view (section) of the first example shown in FIG. 1.
Figure 3:
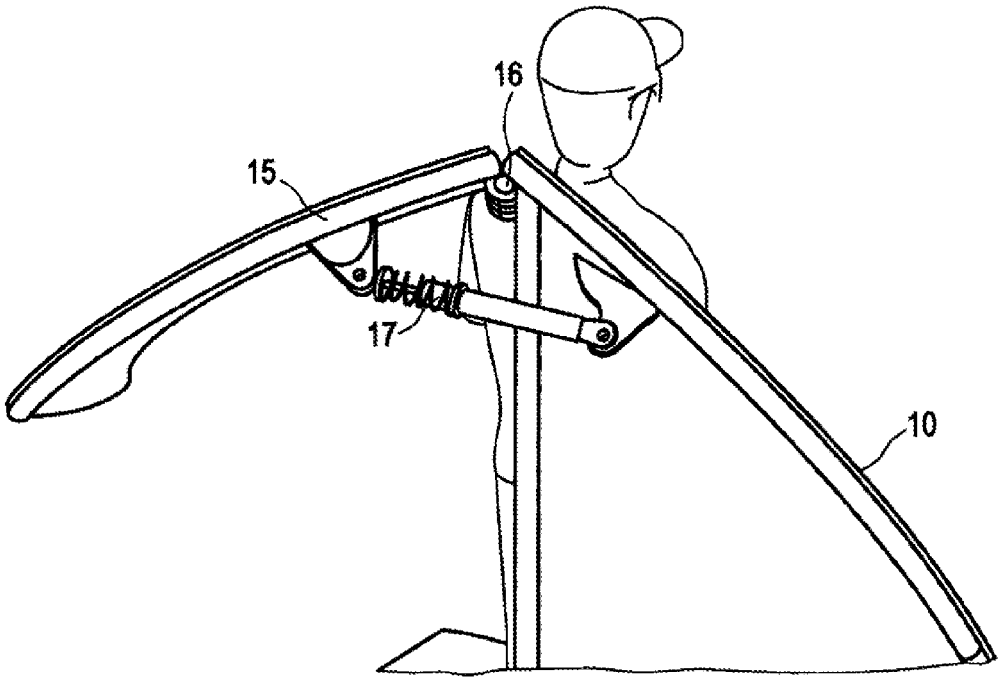
FIG. 3 shows another perspective rear view (section) of the first example shown in FIG. 1.

This is illustrated in detail in FIGS. 2 and 3 which each show a perspective rear view of the first example shown in FIG. 1. The position of the subsection 15 of the guide 10 shown in FIG. 2 corresponds to the first position shown in FIG. 1 in which the subsection 15 lies in the path of the guide 10 and forms a part of the guide 10.

In the example shown in FIG. 3 the subsection 15 was pivoted rearwards from the originally specified path of the guide 10 with the aid of the hydraulic system 17 on the hinge 16 so that this subsection is located in a second position. In this second position the subsection 15 of the guide 10 is reached more by the golf club when, after teeing off the golf ball, this is moved by the golf player 20 over the shoulder of the golf player 20 in the direction of the rear upper free end of the guide 10 during the follow-through and the subsequent so-called finish.

Figure 4:
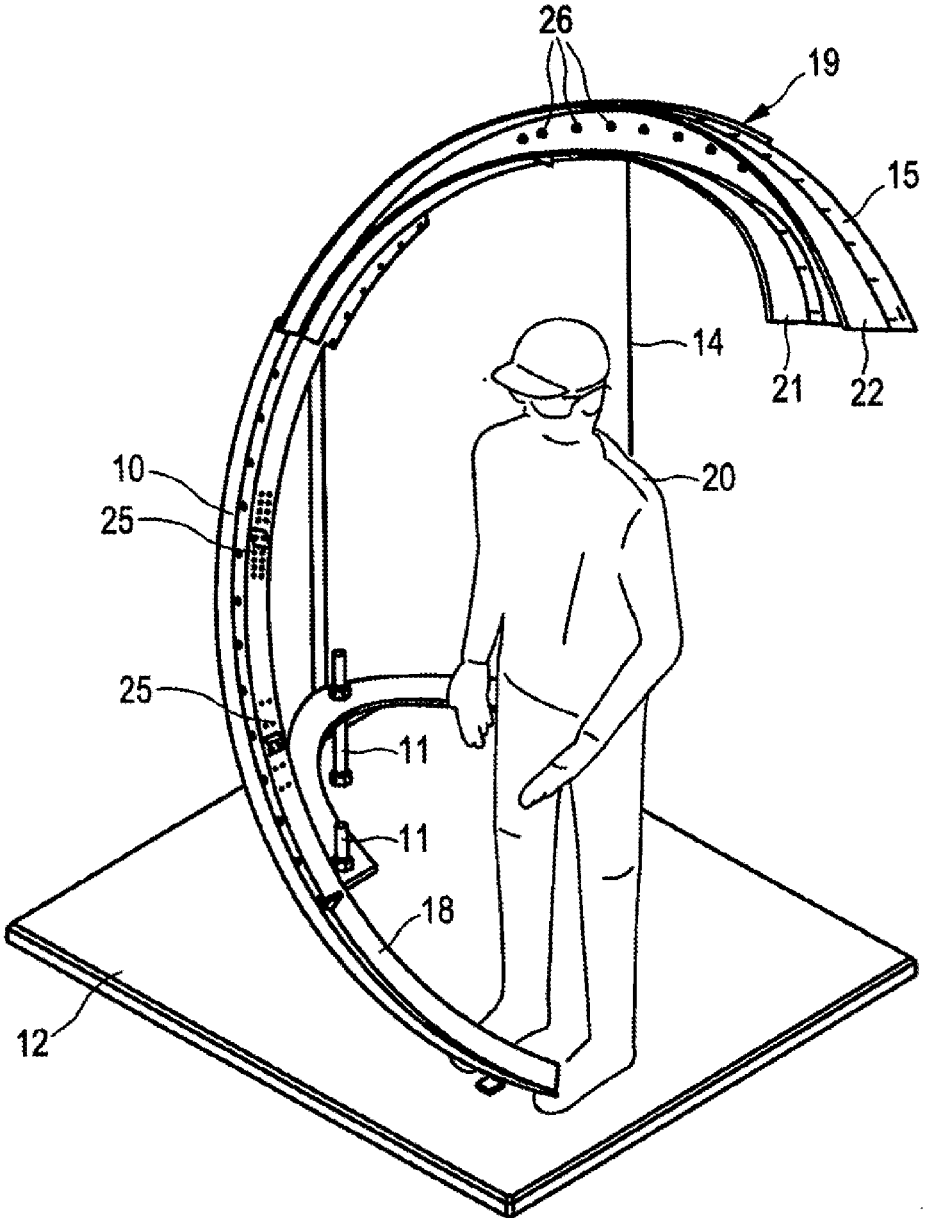
FIG. 4 shows a perspective front view of the second example of the device according to the invention.
Figure 5:
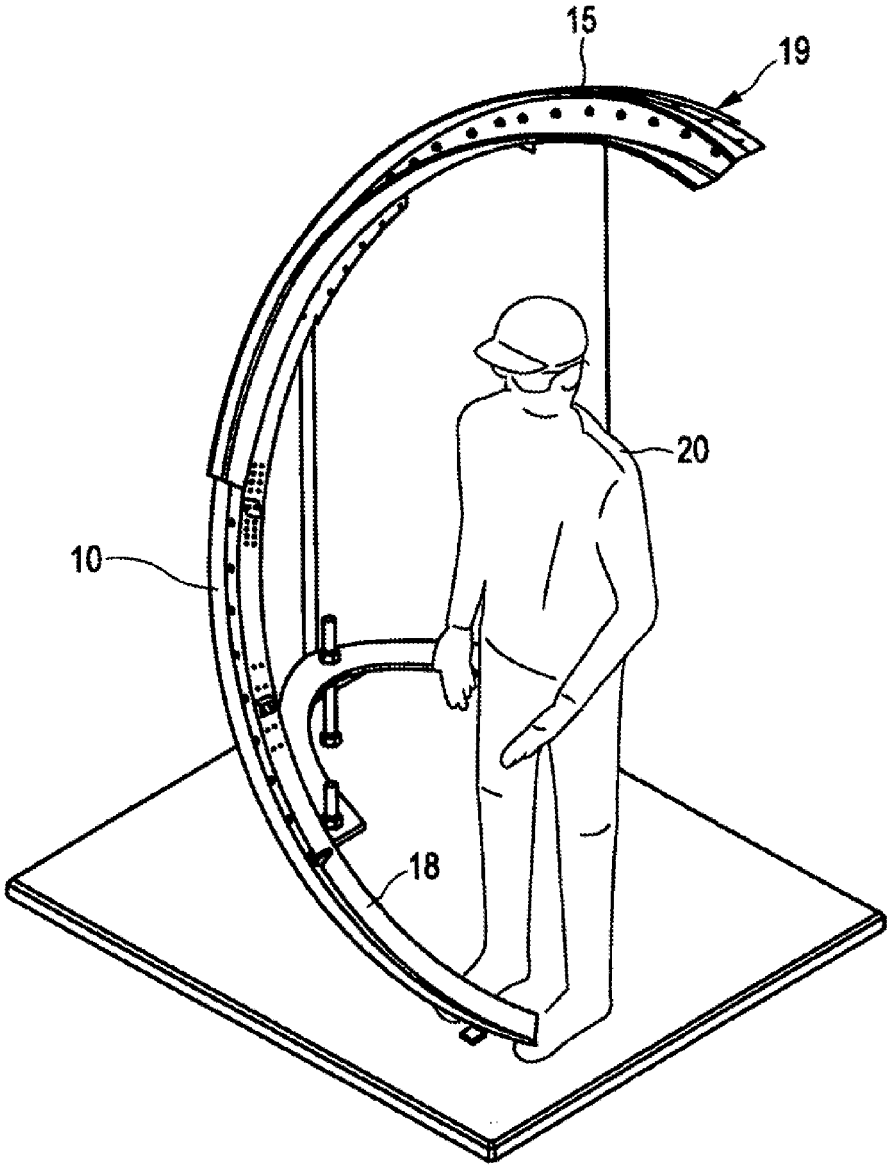
FIG. 5 shows another perspective front view of the second example shown in FIG. 4.

FIGS. 4 and 5 each show a perspective front view of a second example of the device according to the invention.

In this example the guide 10 is supported by a wall 14 which stands on a base plate 12 on adjustable-height legs 11. The lower region of the guide 10 is formed by a curved rod which in the upper region of the guide 10 goes over into parallel-running curved walls 21 and 22 which form a trough-like region of the guide 10.

Inside the path predefined by the guide 10 runs a support element 18 which, in the example shown, is formed from a trough having a U-shaped profile or a tube having a rectangular cross-section. On the support element 18 and in the upper trough-like region of the guide 10, sensors 25 or 26 are provided, which are used to detect the position and/or the orientation and/or the speed and/or the acceleration of the golf club guided along the path of the guide 10.

In the region of its upper free end the guide 10 has a subsection 15 which in the manner according to the invention, can be displaced by a device anticlockwise in the direction of the arcuate path of the guide 10 and thereby exposed the upper free end of the guide 10 for a complete swinging-out of the golf club at the finish.

This state of the device is shown in FIG. 5. The guide 10 was shortened in a telescopic manner by a displacement of the subsection 15 long the path predefined by the guide 10 whereby the trough-like region was displaced along the guide 10.

Preferably the guide 10, in particular the upper trough-like region of the guide 10, is displaceably mounted on a subregion 19 of the support element 18. A carriage mechanism can be provided for the displacement in which the underside of the trough-like region, in particular the subsection 15, is provided with skids which run along the path of the guide 10 and engage in corresponding grooves in the subregion 19 of the support element 18.

Figure 6:
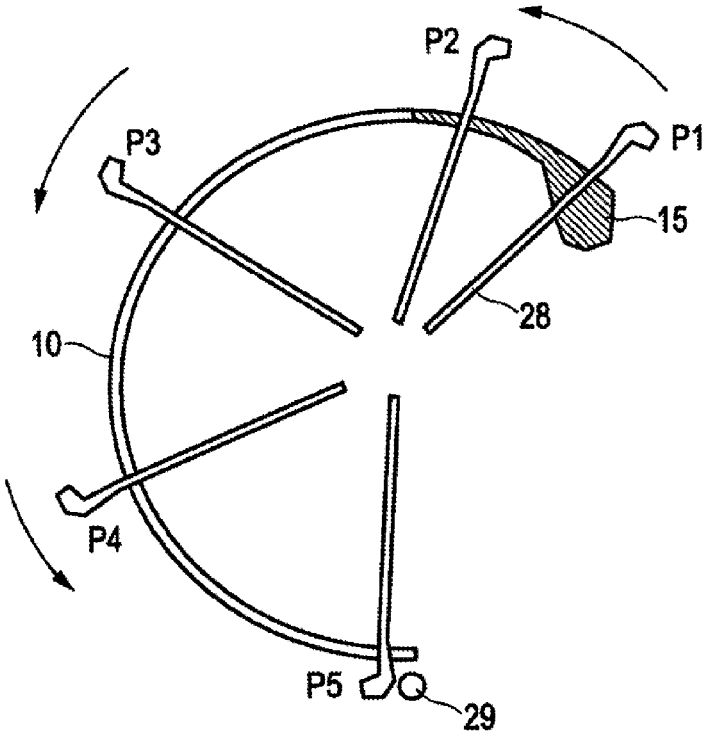
FIG. 6 shows a highly schematic front view of the guide with a golf club shown in FIG. 1 in specific phases of the golf swing.
Figure 7:
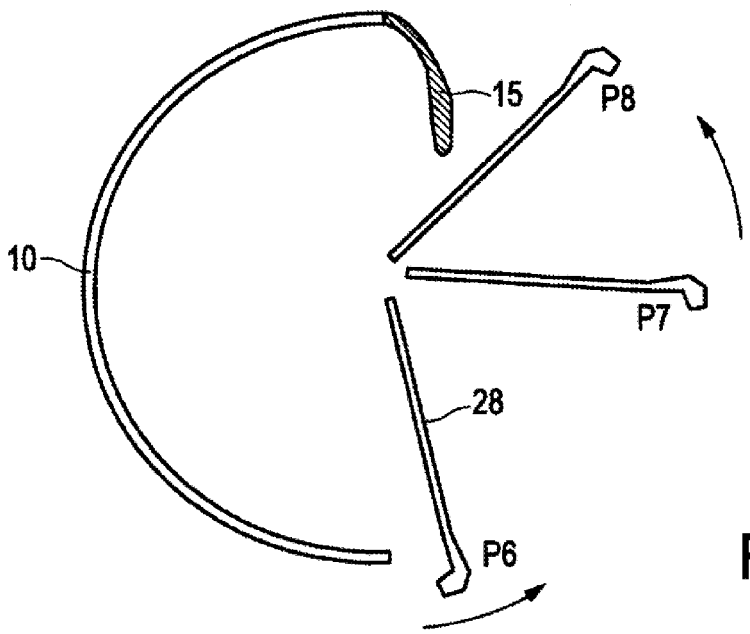
FIG. 7 shows a highly schematic front view of the guide with a golf club shown in FIG. 1 in further phases of the golf swing.

FIGS. 6 and 7 each show a highly schematic front view of the guide 10 shown in FIG. 1 together with a golf club 28 in different phases P1 to P8 of the golf swing.

FIG. 6 shows the golf club 28 in a phase P1 in which this is located at the beginning of the downswing movement which is indicated in the figure by arrows in the anticlockwise direction. During the downswing movement the golf club 28 is moved by the golf player—not shown for reasons of clarity—initially along the subsection 15 of the guide (phases P1 and P2) and then along the remaining region of the guide 10 (phases P3 and P2) until this finally hits the golf ball 29 in phase P5 and sets this in motion. In golfing language this instant is designated as impact moment or impact.

FIG. 7 shows the position of the golf club 28 which after the impact moment leaves the guide 10 and after the follow-through (phases P6 and P7) finally reaches the so-called finish (phase P8). In this phase the golf club 28 is usually severely inclined towards the rear, which however cannot be identified in FIG. 7 on account of the highly schematic representation.

As has already been explained in connection with the example shown in FIGS. 1 to 3, the subsection 15 of the guide 10 is pivoted rearwards in good time from its original first position (see FIG. 6) into the second position shown in FIG. 7 so that during or after the follow-through, in particular at the finish, the golf club 28 cannot come in contact with the subsection 15 in the phase P8 shown and therefore a complete follow-through movement including finish is made possible without this being disturbed or hindered by the subsection 15 of the guide 10 required for practicing the downswing.

Figure 8:
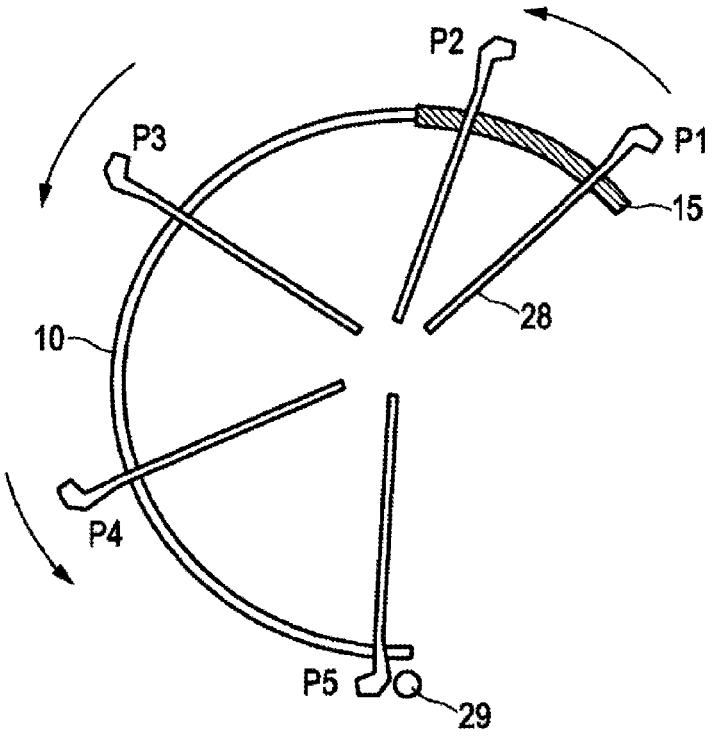
FIG. 8 shows a highly schematic front view of the guide with a golf club shown in FIGS. 4 and 5 in specific phases of the golf swing.
Figure 9:
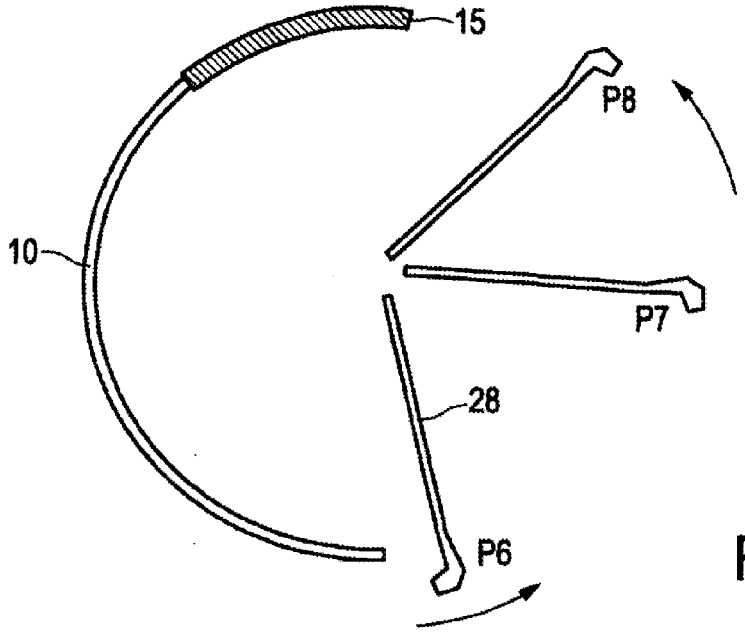
FIG. 9 shows a highly schematic front view of the guide with a golf club shown in FIGS. 4 and 5 in further phases of the golf swing.

FIGS. 8 and 9 each show a highly schematic front view of the guide 10 shown in FIGS. 4 and 5 with a golf club 28 in different phases of the golf swing. The explanations to the example shown in FIGS. 6 and 7 apply here accordingly where in this case, the subsection 15 of the guide 10 is not brought into the second position by a pivoting from its original first position but by a displacement along the guide 10 as has already been explained in connection with the exemplary embodiment shown in FIGS. 4 and 5.

By reference to FIGS. 8 and 9 it is clear that in this exemplary embodiment of the invention, on the one hand the path of the golf club during the backswing and downswing (phases P1 to P5) can be exactly predefined without on the other hand the freedom of movement of the golf player during the follow-through (phases P6 and P7) and in particular finish (phase P8) being restricted in relation to the posture of the golf club 28.

As has already been mentioned in connection with the exemplary embodiment shown in FIG. 4, sensors 25 are provided on the support element 18 of the device, which are used to detect the position and/or the orientation and/or the speed and/or the acceleration of the golf club guided along the path of the guide 10. As can be seen in FIG. 4, further sensors 26 can be provided on the trough-shaped subsection 15 of the guide 10. The same applies to the exemplary embodiment shown in FIG. 1 in which—even if this cannot be identified in the diagram selected there—sensors are provided both in the lower region of the guide 10, i.e. on the curved rod and also in the upper region of the guide, i.e. in particular on the subsection 15.

If the respective subsection 15 of the guide 10 in its first position forms a part of the guide 10, the sensors 26 located thereon can reliably detect the motion quantities, in particular location and speed, of the golf club during the backswing and downswing. Since in further phases of the golf swing the respective subsection 15 can then be pivoted or displaced in the manner according to the invention into a second position in which this no longer lies in the path of the guide 10, in addition to the increased freedom of movement for the golf player 20, the advantage is initially achieved that the sensors 26 located on the subsection 15 cannot be damaged by an impact of the golf club in these phases, in particular at the finish.

Figure 10:
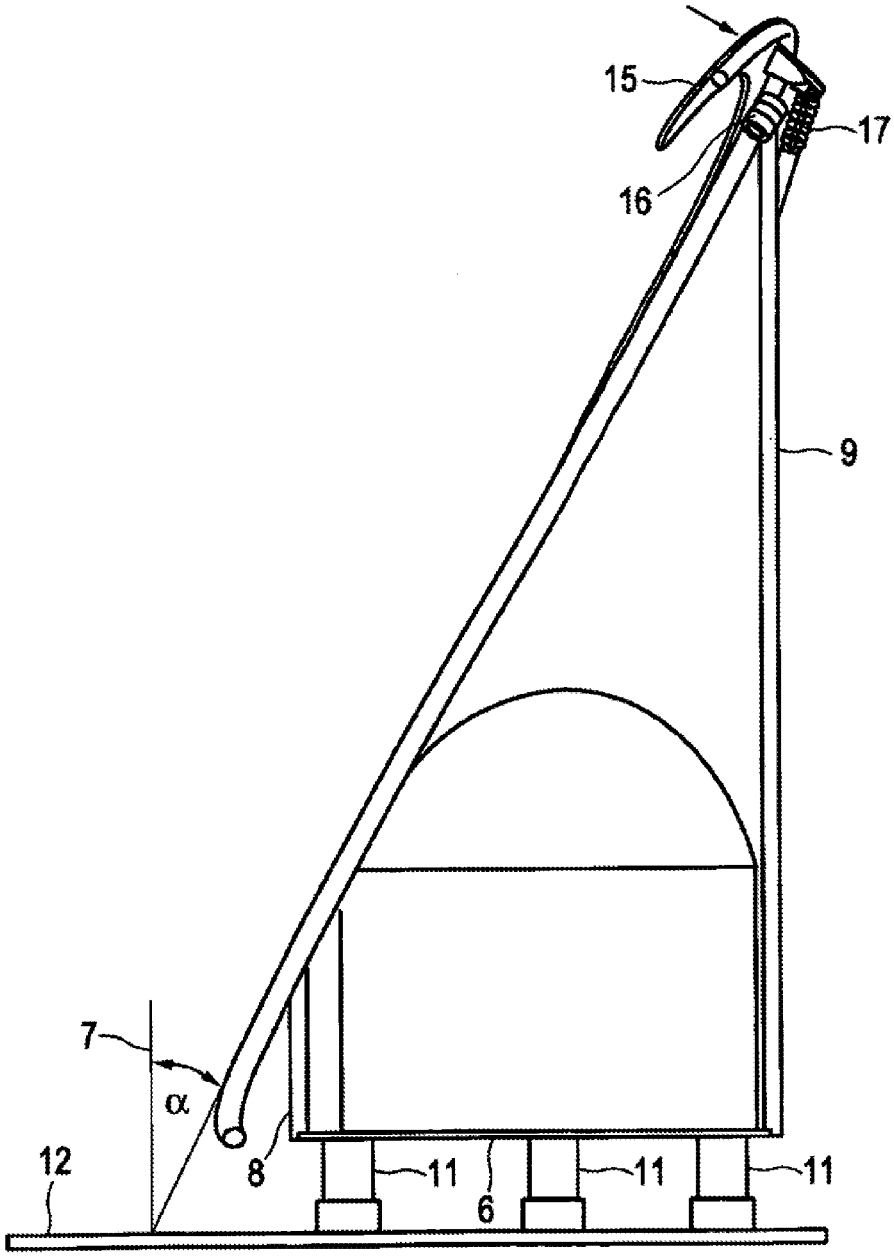
FIG. 10 shows a side view of the first example of the device according to the invention shown in FIG. 1.

FIG. 10 shows the first example of the device according to the invention shown in FIG. 1 in a side view. As can be seen, the guide 10 is supported by two vertically running rods 8 and 9 disposed on a transverse member 6. The transverse member 6 is provided with adjustable-height legs 11 with which the device stands on the base plate 12.

The subsection 15 can be seen in the upper region of the guide 10, which can be pivoted rearwards by means of the hinge 16 and the hydraulic system 17 in the direction of the arrow indicated in the figure.

In the example shown, the path of the guide 10 runs in a plane which is inclined at an angle $\alpha$ to the vertical 7. The device can preferably be configured so that the inclination of the guide 10 with respect to the vertical 7 can be varied. In conjunction with or alternatively to the adjustable-height legs 11, the training device according to the invention can in this way be adapted to golf players having different height, constitution or golf swing techniques or to different training purposes. The angle $\alpha$ is preferably between about 30° and 40°, in particular about 35°. The corresponding angle of inclination with respect to the horizontal therefore preferably lies between about 50° and 60°, in particular about 55°.

Figure 11:
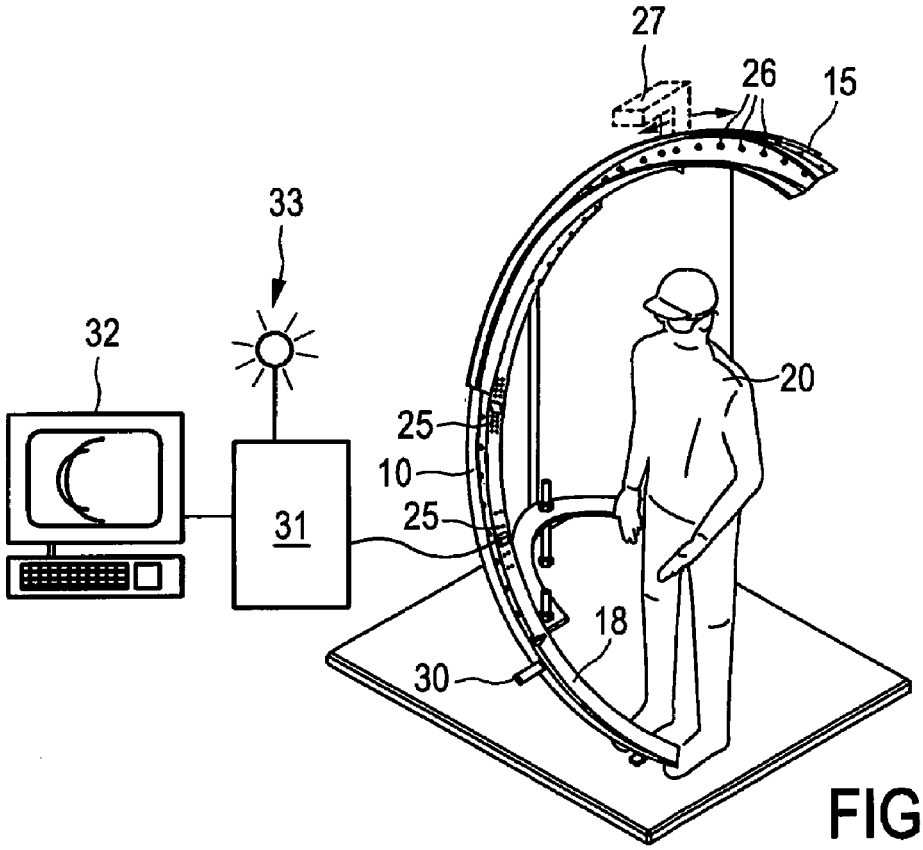
FIG. 11 shows a further perspective front view of the second example of the device according to the invention.

FIG. 11 shows a further development of the second example of the device according to the invention shown in FIGS. 4 and 5, by reference to which the control of the subsection 15 of the guide 10 is explained as an example. In principle, the following explanations also apply accordingly to the first example of the device according to the invention shown in FIGS. 1 to 3.

A mechanical triggering mechanism can be provided for controlling the subsection 15 of the guide 10, which mechanism is triggered by contact with the golf club guided along the specified path of the guide 10. Preferably a pin 30 disposed on the support element 18 or on the guide 10 can be provided for this purpose, which pin is coupled to a trigger mechanism located in the support element 18, which in turn releases the subsection 15 for a displacement or brings about the displacement thereof.

Alternatively or additionally the subsection 15 can be controlled electronically whereby the presence of the golf club in a certain position on its path along the guide 10 is detected, for example, by means of the sensors 25 and/or 26. The sensor signals generated by the sensors 25 or 26 are supplied to a control unit 31, in particular a computer, which—possibly after an evaluation of the sensor signals—generates a corresponding control signal by which means the device for displacement of the subsection 15 is set in motion.

It is also possible to control the subsection 15 electromechanically whereby, for example, the pin 30 is configured as an electrical switch which, when actuated by the golf club, sends a corresponding switching signal to the control unit 31 which can then set in motion the device for displacement of the subsection 15.

As has already been explained above it is possible with the aid of the sensors 25 and/or 26 to gain information on the swing path covered by the golf club and/or its speed and/or its acceleration along the swing path. In the event that at least a proportion of the sensors 25 or 26 are configured as distance sensors, it is furthermore possible to detect any deviations of the golf club from the specified path or the correct plane of the golf swing.

The detected information can be displayed graphically, preferably on a monitor 32 in the form of a "swing pattern" and can show the golf player 20, for example, in which phases of the golf swing the golf club deviates from a specified swing path or speed or acceleration. In this way, it can also be illustrated whether and at which time the golf club leaves the correct plane of the golf swing.

Alternatively or additionally it is possible to configure the control unit 31 so that this triggers an audible and/or visual signal 33 when the golf club deviates from the specified swing path, in particular from the correct plane or speed or acceleration. The golf player 20 thus already receives feedback about any errors during the golf swing and can immediately correct this.

Alternatively or additionally a stop element 27 (dashed) can be provided, which is disposed in the region of the guide 10, in particular in the upper region thereof and/or in the region of the subsection 15 in such a manner that the golf club can come in contact with this at the end of the backswing movement. As a result of the impact of the golf club on the stop element 27 and the associated noise and/or vibrations of the golf club, the golf player receives an acoustic or haptic feedback that the end of the backswing movement is reached. In this way, the practicing of the golf swing can be specifically improved, particularly with regard to the backswing.

Depending on the height, constitution and game technique of the golf player and depending on the training purpose, the stop element 27 can be disposed more towards the upper end of the guide 10 or away from this along the direction arrows indicated in FIG. 11. The base body of the stop element 27 can be made of metal and, at least in the region of the expected impact of the golf club, can be provided with an in particular elastic protective covering, which prevents damage to the stop element 27 on the one hand and to the golf club on the other hand. In the simplest case, for example, foam or rubber can be used for this purpose.

Similarly to the subsection 15 of the guide 10, a suitable device (not shown) can be provided which can bring the stop element 27 from a first position in which this lies in the specified path and can come in contact with said element during the backswing of the golf club into a second position in which the stop element 27 does not lie in the path. This enables an improved practicing of the backswing without the follow-through or the finish at the end of the golf swing being impeded.

Alternatively or additionally to the mechanical stop element 27 described, its function with regard to a feedback on reaching the end of a specified backswing movement can be taken over or assisted by the sensors 26 at the upper end of the guide 10, in particular in the region of the subsection 15. In this embodiment the presence of the golf club in the upper region of the guide 10 is detected by sensors 26, which produce corresponding sensor signals which are fed to the control unit 31. The control unit 31 here is configured in such a manner that this triggers a visual and/or audible signal 33 when the golf club is located in the region of specific sensors 26 and therefore in a defined local region of the guide 10. The golf player in this way receives visual or audible feedback about the attainment of the end position during the backswing.

Figure 12:
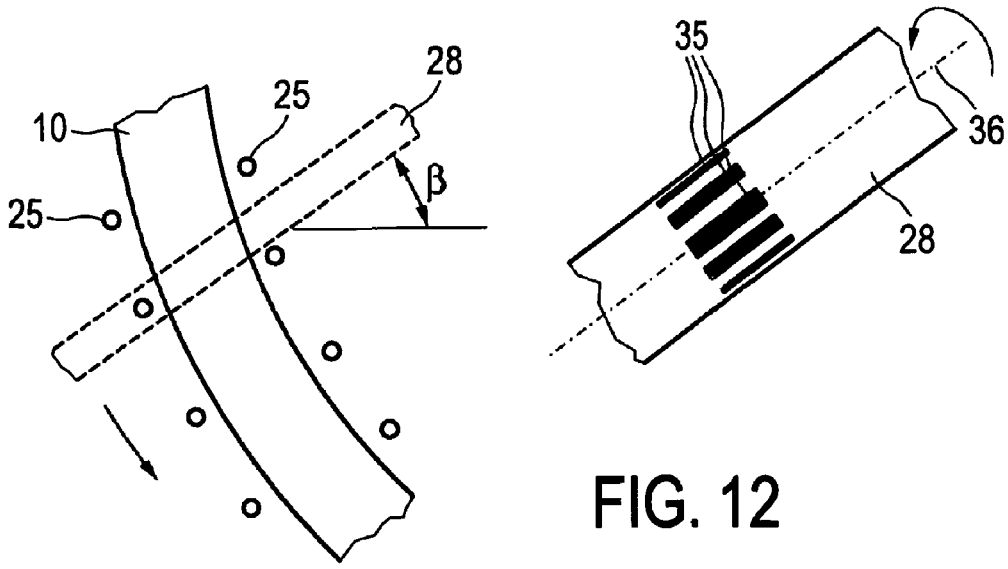
FIG. 12 shows a schematic view of one embodiment of the device according to the invention.

FIG. 12 shows a schematic diagram of respectively one section of the guide 10 and the golf club 28 to explain further embodiments of the device according to the invention.

As can be seen in the left part of FIG. 12, in one embodiment sensors 25 are arranged at a certain distance from one another on both sides of at least one section of the guide 10, preferably opposite one another in pairs.

On its path along this section of the guide 10 in the direction of the indicated arrow, the golf club 28 successively covers the individual sensors 25, which produces correspondingly staggered sensor signals. These signals are relayed to the control device 31 (see FIG. 11) and evaluated there in such a manner that information about the respective orientation of the golf club 28 is obtained, preferably the respective radial position of the golf club 28 and/or its respective angle of inclination β with respect to the horizontal.

Alternatively or additionally the golf club 28 and/or the sensors 25 can be configured such that the axial position of the golf club 28 can also be detected or determined. This is explained for example by reference to a further section of the golf club 28 shown in the right part of FIG. 12.

The section of the golf club 28 which is guided in the region of the guide 10 during the golf swing can be provided with markings 35 which can be detected by the correspondingly configured sensors 25. In this case, it is fundamentally sufficient if the sensors 25 are only arranged along one side of the guide 10. In this case, the sensors 25 can be configured as active sensors which, for example, can emit and receive light or other electromagnetic radiation. In principle, however, passive sensors are also suitable which can only detect electromagnetic radiation such as, for example, photodiodes or CCD arrays.

In the example shown, the markings 35—possibly in the manner of a barcode—are configured such that these have a radial extension dependent on the respective axial position of the golf club shaft. Depending on the rotation of the golf club 28 in the direction of the indicated arrow about the axis 36 of the shaft thereof, the sensors 25 detect variously large markings 35 and generate correspondingly different sensor signals from which in turn the axial position of the golf club 28 can be derived in the control unit 31 (see FIG. 11).

In order to achieve a particularly secure sensory detection of the markings 35, these can be configured to be light-reflecting or absorbing. Alternatively or additionally the marking can comprise a phosphorescent substance which, after irradiation by light—as in the case of a clock face—emit light for a certain time.

Figure 13:
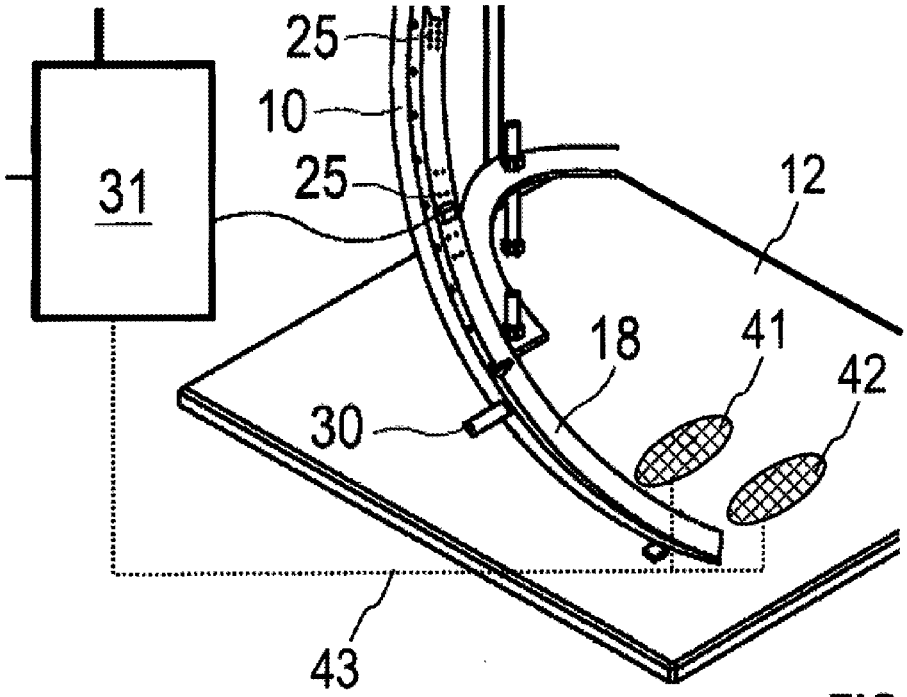
FIG. 13 shows a perspective front view of a third example of the device according to the invention.

FIG. 13 shows a perspective front view of a section of a third example of a device for practicing the golf swing. In the base plate 12 of the device two pressure distribution sensors 41 and 41 are provided in the region of the location provided for the golf player (cf. FIG. 11), which can detect a pressure distribution in the region of the feet of the golf player. A pressure distribution in the sense of this embodiment is to be understood here as any information which forms a measure for the weight forces which occur per unit area in the region of the feet. Instead of two pressure distribution sensors 41 and 42 for both feet, alternatively only one pressure distribution sensor for one foot can also be provided.

Preferably the pressure distribution sensors 41 and 42 each comprise a two-dimensional arrangement of individual pressure-sensitive sensors whose signals are transmitted via an, in particular wireless, connection 43 to a control unit and are there subject to processing and possibly evaluation. Alternatively or additionally the pressure distribution sensors 41 and 42 can also be accommodated in the shoe soles of the golf player, which allows a particularly accurate detection of the pressure distribution in the region of the particular foot area—e.g. heel, toe, outer foot—and permits a very differentiated examination of the pressure distribution.

For example, the detected pressure distribution can be compared with previously stored desired values which correspond to a correct weight distribution in the particular phase of the golf swing. In the event of a deviation of the detected pressure distribution from the desired values, this can be displayed visually and/or audibly so that the golf player can accordingly correct his posture or weight distribution in the current or next golf swing.

The explanations in connection with FIG. 11 apply accordingly for the optical or acoustic display by means of monitor 32 or signal 33 and elsewhere.

Figure 14:
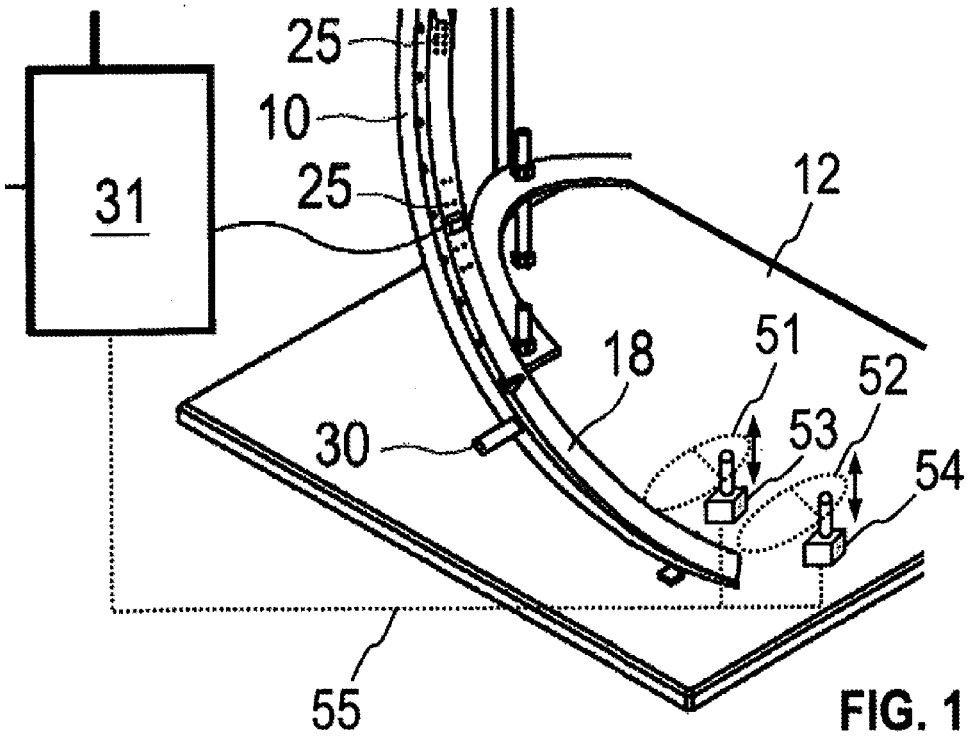
FIG. 14 shows a perspective front view of a fourth example of the device according to the invention.

FIG. 14 shows a perspective front view of a fourth example of a device for practicing the golf swing. In the base plate 12 of the device, two elements 53 and 54 are provided below the regions 51 and 52 provided for the feet of the golf player (cf. FIG. 11), which elements can give a haptic signal, for example, in the form of impacts or a vibration, to the particular foot or shoe sole—preferably in the heel region—of the golf player standing on the regions 51 and 52. Instead of two elements 53 and 54 for both feet, only one such element can be provided for only one foot.

The elements 53 and 54 are preferably coupled via a connection 55 to the control unit 31 and are controlled by this. The elements 53 and 54 can, for example, comprise a tappet which is driven by an electromechanical actuator and can hit against the sole of the golf player. Alternatively however the elements 53 and 54 can also be configured as vibration elements which can act upon the sole of the golf player with a vibration signal.

As a result of the output of a haptic signal, in particular in the form of one or more impacts or a vibration, to the foot of the golf player, information is transmitted to said golf player on the correct posture, position or weight shift in a simple, reliable and intuitively easy to detect manner. The golf player can therefore concentrate on executing the golf swing without, for example, needing to pay attention to a corresponding display of the information on a monitor 32 or an optical signal 33 (cf. FIG. 11).

The embodiment shown in FIG. 14 can advantageously be combined with the embodiment of the invention shown in FIG. 13. The information given to the golf player in the form of a haptic signal can in this case be derived from the position of weight shift of the golf player detected by the pressure distribution sensors 41 and 42 and in particular can be a correction instruction if the detected position or weight shift deviates from a specified desired value.

Alternatively or additionally, the transmitted information can however also comprise an indication to pay attention to the body position, posture or weight shift required in each case in a certain swing phase. Thus, the elements 53 and 54 can, for example, be controlled so that they knock on the heel region during a certain swing phase. For example, during the downswing the heel of the right foot is knocked by the element 53 to signal to the golf player that a weight shift onto the left of right foot needs to take place.

Otherwise, the explanations relating to FIG. 11 are valid for FIG. 14.

Figure 15:
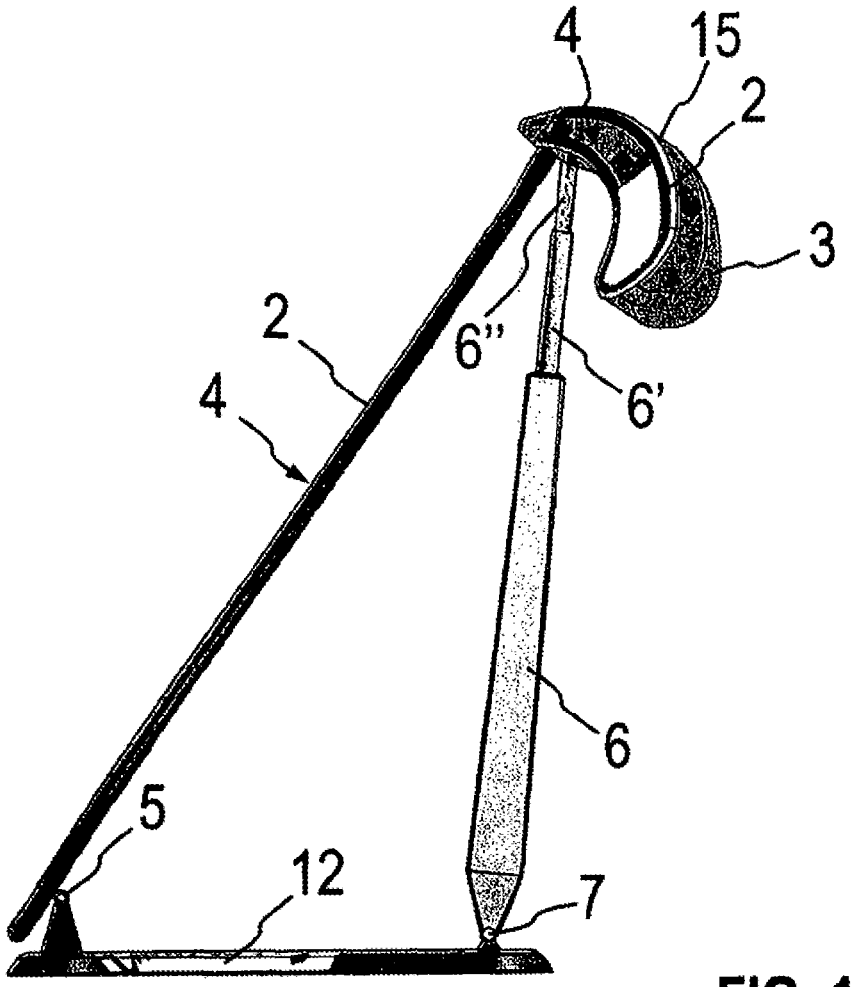
FIG. 15 shows a side view of a fifth example of the device according to the invention.
Figure 16:
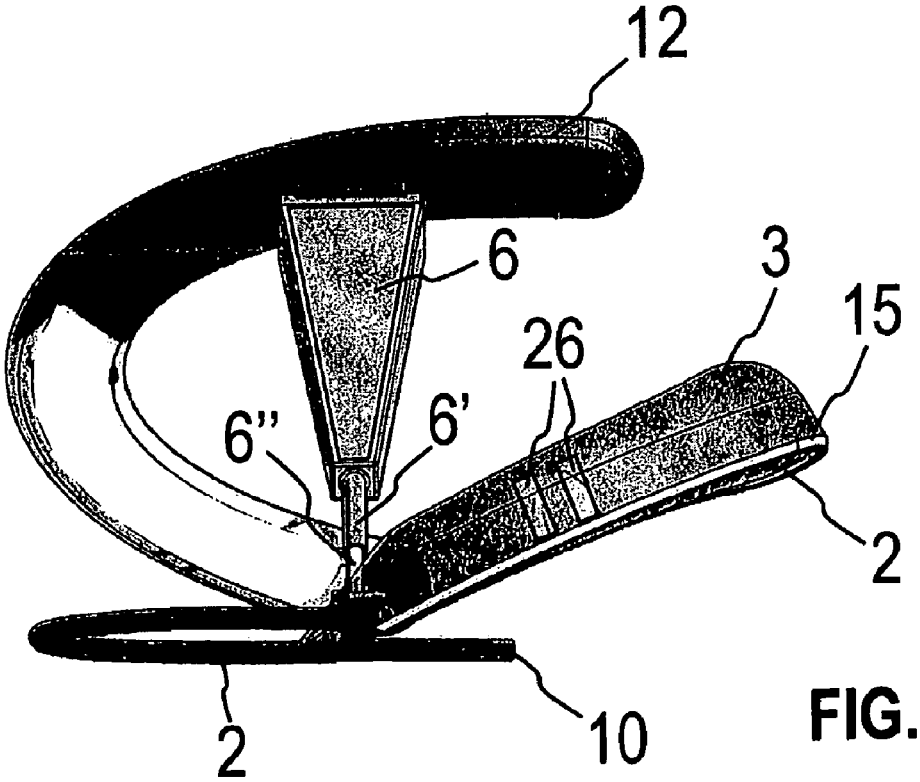
FIG. 16 shows a plan view of the fifth example of the device according to the invention.

FIGS. 15 and 16 show a side view or plan view of a fifth example of the device according to the invention. Unlike the mounting by means of rods 8 and 9 or legs 11 and walls 21 and 22 shown, for example, in FIGS. 1 and 4, the guide 10 in this example is mounted in the lower region by means of a first joint 5 and in the upper region by means of a telescopic support 6 with a second joint 7 on the base plate 12. The length of the support 6 can be adjusted by retracting or extending the segments 6' and 6" preferably hydraulically. The individual segments 6' and 6" of the telescopic support 6 can however also be locked positively and/or non-positively relative to one another by means of locking screws or bolts to adjust a certain length of the support 6. The angle of inclination of the guide 10 with respect to the vertical or horizontal can be adjusted within certain limits by the length of the support 6.

In the upper region of the guide 10 a subsection 15 is pivotally mounted and controlled in such a manner that this is pivoted out from the original path of the guide 10 when the golf club during the golf swing has reached the phase of the follow-through and/or finish. The above explanations in connection with the exemplary embodiments shown in FIGS. 1 to 3 apply accordingly.

During the golf swing the golf club is guided on a front region 4 of the guide 10 including the subsection 15 along the specified path. In the preferred embodiment shown here a wear protection 2 is provided in the front region which reduces frictional forces between golf club and guide 10 or subsection 15 and/or prevents or at least reduces abrasion at the guide 10 or on the subsection 15 as well as on the golf club.

The wear protection 2 is preferably designed to be replaceable so that this can be removed from the guide 10 or from the subsection 15 if required and replaced by a new one or another one. For example, the wear protection 2 can be designed as self-adhesive tape that can be glued to the guide 10 or the subsection 15 and removed again if necessary.

In the example shown two ultrasound sensors 26 (see FIG. 16) are provided on the subsection 15, which can detect the presence of the golf club in the region of the subsection 15. Similarly to the exemplary embodiment shown in FIG. 11, the electrical signals generated by the ultrasound sensors 26 can be relayed to a control unit 31 which for its part instigates the output of an optical, acoustic or haptic signal in order to signal to the golf player that the golf club has reached the initial position required for the beginning of the downswing. When the shaft of the golf club therefore covers one or both of the spaced-apart ultrasound sensors 26 during the backswing, an in particular acoustic signal is output in order to signal to the golf player that the shaft has reached the required or correct shaft angle in the region of an envisaged turning point and can begin the downswing. Naturally in this embodiment, corresponding optical sensors can also be used instead of ultrasound sensors 26.

A cover 3 is arranged in the rear region of the subsection 15 which serves to protect the rearward part of the ultrasound sensors 26 and optionally an electronic system required for its control from environmental influences.

The arcuate guide 10 is preferably tubular and has a cavity through which electrical and/or hydraulic leads for the ultrasound sensors 26 or an electric motor or hydraulic mechanism 17 (cf. FIGS. 1 to 3) for pivoting the subsection 15 can be guided. The guide 10 can preferably have an oval cross-section.

What is claimed is:

1. A device for practicing a golf swing, wherein the device comprises an arcuate guide along which a golf club can be guided on a specified path, which guide is inclined towards the vertical and comprises at least one section which is pivotally mounted on an upper end of the guide by a hinge, a positioning device configured to bring the at least one section from a first position in which the section lies in the specified path into a second position in which the section lies outside the specified path, by pivoting the at least one section in a direction of a rear region of the guide, the positioning device comprising a motor drive or a hydraulic drive, respectively, the motor drive or hydraulic drive being configured to pivot the at least one section in the direction of the rear region of the guide, and a control unit configured to control the positioning device to pivot the at least one section in the direction of the rear region of the guide during follow-through and/or finish of the golf swing.

2. The device of claim 1, wherein the positioning device is configured so that the at least one section is brought into the second position in at least one phase of the golf swing.

3. The device of claim 2, wherein the at least one phase of the golf swing is at least one of follow-through and finish.

4. The device of claim 1, wherein the golf club does not come into contact with the at least one section located in the second position.

5. The device of claim 1, wherein the golf club can be guided on the specified path in a front region of the guide.

6. The device of claim 1, wherein the at least one section is located at an upper free end of the guide.

7. The device of claim 1, wherein in a region of the guide the device further comprises one or more sensors for detecting at least one of a position, an orientation, a speed, and an acceleration of the golf club guided along the path.

8. The device of claim 1, wherein the device further comprises at least one detection device for detecting at least one of a position, a posture, and a weight shift of a golf player.

9. The device of claim 8, wherein the at least one detection device comprises a pressure distribution sensor which can detect a pressure distribution in a region of at least one foot of the golf player.

10. The device of claim 9, wherein the pressure distribution sensor can detect a pressure distribution in the region of at least one foot of the golf player during the golf swing.

11. The device of claim 8, wherein the device further comprises at least one output device for outputting information relating to at least one of a position, a posture, and a weight shift of a golf player.

12. The device of claim 11, wherein the output device is configured for outputting a haptic signal to a foot of the golf player.

13. The device of claim 12, wherein the haptic signal is in a form of one or several impacts or vibrations.

14. The device of claim 1, wherein the device further comprises at least one output device for outputting information relating to at least one of a position, a posture, and a weight shift of a golf player.

15. The device of claim 14, wherein the output device is configured for outputting a haptic signal to a foot of the golf player.

16. The device of claim 15, wherein the haptic signal is in a form of one or several impacts or vibrations.

17. A method for practicing a golf swing, wherein the method comprises using the device of claim 1.

18. A method for practicing a golf swing, wherein the method comprises guiding a golf club along an arcuate guide on a specified path, the guide being inclined towards the vertical and comprising at least one section which is pivotally mounted on an upper end of the guide by a hinge, a positioning device comprising a motor drive or hydraulic drive bringing the at least one section from a first position in which the section lies in the specified path into a second position in which the section lies outside the specified path, by pivoting the at least one section in a direction of a rear region of the guide, and a control unit controlling the positioning device to pivot the at least one section in the direction of the rear region of the guide during follow-through and/or finish of the golf swing.

* * * * *